United States Patent [19]

Watrous et al.

[11] Patent Number: 4,547,114

[45] Date of Patent: Oct. 15, 1985

[54] POSITIVE CONTROL STACKER

[75] Inventors: Howard N. Watrous, West Chester; Walter Cash, Jr.; Weldon R. Dixon, both of Cincinnati, all of Ohio

[73] Assignee: The Procter & Gamble Company, Cincinnati, Ohio

[21] Appl. No.: 428,319

[22] Filed: Sep. 29, 1982

[51] Int. Cl.[4] ..... B65H 29/42

[52] U.S. Cl. ..... 414/81; 198/422; 198/625; 271/179; 414/36; 414/94

[58] Field of Search ..... 414/36, 48, 49, 69, 414/76, 81, 94; 198/422, 625; 271/179, 212

[56] References Cited

U.S. PATENT DOCUMENTS

| | | | |
|---|---|---|---|
| 1,305,501 | 6/1919 | Steele | 414/81 X |
| 2,300,863 | 11/1942 | Bamford | 271/179 |
| 2,609,779 | 9/1952 | Goldsworthy | 113/114 |
| 3,063,577 | 11/1962 | Shields | 214/6 |
| 3,203,561 | 8/1965 | Shields | 214/6 |
| 3,280,679 | 10/1966 | Huffman | 83/79 |
| 3,712,487 | 1/1973 | Eberle | 214/6 BA |
| 4,054,403 | 10/1977 | Hornbeck et al. | 425/133.1 |
| 4,077,753 | 3/1978 | Tanaka | 425/131.1 |
| 4,108,319 | 8/1978 | Kacirek et al. | 214/6 BA |
| 4,378,938 | 4/1983 | Staniszewski | 414/94 X |

*Primary Examiner*—Robert J. Spar
*Assistant Examiner*—Janice Krizek
*Attorney, Agent, or Firm*—Frost & Jacobs

[57] ABSTRACT

A stacker for rigid and semi-rigid sheet or pad-like products forming individual stacks thereof of specific count and with the edges of the product in each stack aligned. The stacker comprises at least one pair of multi-thread screws, being mirror images of each other, rotating continuously at the same speed but in opposite directions. Products are continuously fed between the screws of the at least one pair, each product being supported by a set of corresponding threads of both screws. All corresponding sets of threads are so loaded and each product is shifted downwardly by its respective thread set while simultaneously being urged forwardly against a stop to align the front and rear edges thereof. The initial portion of the shaft of each multi-thread screw tapers downwardly and outwardly to align the side edges of the products. When all of the corresponding thread sets have been product filled, the corresponding thread sets terminate one-by-one so as to accumulate a stack from top to bottom, the last thread set to terminate depositing a stack of aligned products equal in number to the number of threads per screw. A single-thread, large pitch screw can be located beneath and coaxial with each of the multi-thread screws, the single-thread screws cooperating to convey or convey and accumulate product stacks formed by the multi-thread screws.

26 Claims, 25 Drawing Figures

POSITIVE CONTROL STACKER

TECHNICAL FIELD

The present invention relates to a stacker for rigid and semi-rigid sheet or pad-like products, and more particularly to a high speed stacker forming individual stacks of products of specific count and with the edges of the products in each stack aligned.

BACKGROUND ART

Prior art workers have devised numerous types of conveyors and stackers utilizing rotating screws having helical threads. For example, U.S. Pat. No. 3,063,577 in the name of Albert F. Shields, issued Nov. 13, 1962, teaches a stacking, straightening and delivery device for box blanks utilizing a pair of helically threaded screws. The box blanks are introduced between the screws which lift the box blanks upwardly. As the blanks move upwardly, they are evenly spaced by the thread pitch of the screws. When a predetermined number of blanks moves above the top of the screw threads, a pusher means removes them from the device. A similar device is taught in U.S. Pat. No. 3,203,561 in the name of Albert F. Shields, issued Aug. 31, 1965.

U.S. Pat. No. 3,712,487, issued in the name of Jurg Eberle on Jan. 23, 1973 teaches a stacking device for substantially flat objects such as paper products, utilizing one or more worm-like conveyor elements rotated about their longitudinal axes and extending between an infeed station and a delivery station. The products are continuously accumulated in a stack at the upper end or ends of the one or more worm-like conveyor elements. U.S. Pat. No. 4,108,319 teaches an accumulator for sheets of glass comprising two pairs of helically threaded rotating shafts. The glass sheets are introduced between the pairs of shafts and are lifted by the helical shaft threads vertically to form a stack at the upper termination of the threads.

U.S Pat. No. 3,280,679 issued to Harold W. Huffman on Oct. 25, 1966 describes a device for receiving individual sheets, lowering each sheet onto the top of a preceding sheet to make a stack thereof containing a predetermined number of sheets. When the predetermined number of sheets is achieved, the entire stack of sheets is vertically discharged, as a unit, onto a conveyor. To this end, a pair of piling screws are provided in side-by-side relationship, with a pair of batching screws located therebeneath. Each batching screw is coaxial with one of the piling screws. The piling screws cooperate to act as a conveyor to lower individual sheets onto the thread plates of the batching screws until a stack of sheets of predetermined number has accumulated thereon. Thereafter, the batching screws make one revolution to deposit the stack on a conveyor. Between depositing revolutions, the batching screws are stationary.

Prior art stacking devices, utilizing helically threaded screws, simply use the screws as vertical conveying means, shifting products vertically upwardly or downwardly, one-by-one. The products are accumulated at the upward or downward terminations of the screw threads. Additional, intermittent means such as pusher means, batching screws or the like are needed to form stacks of a specific count. As a result, mechanical parts utilizing intermittent motion are required and such stacking devices are speed limited.

The present invention is based upon the discovery that one or more cooperating pairs of screws, having properly configured helical threads, can, themselves, be utilized to form product stacks of specific count, the products of each stack being aligned. The stacker of the present invention will accept single or multiple product input and is capable of high speed operation using continuous motion. One or more pairs of continuously rotating single-thread screws can be utilized in conjunction with the one or more pairs of stacker screws to simply convey the stack formed by the stacker screws, or to accumulate and convey the stacker screw stacks, depending upon the rotational speed of the single-thread screws, relative to the stacker screws.

DISCLOSURE OF THE INVENTION

According to the invention there is provided a stacker for rigid and semi-rigid sheet or pad-like products forming individual stacks thereof of specific count, and with the edges of the products in each stack aligned. The stacker comprises at least one pair of multi-thread screws. The stacker screws of a pair comprise mirror images of each other and rotate continuously at the same speed, but in opposite directions. The stacker screws of a pair are so radially aligned that corresponding threads of the screws occupy corresponding positions. The stacker screws of a pair are located in side-by-side relationship with their corresponding threads opposed.

Products are continuously fed between the stacker screws of the at least one pair, each product contacting and being supported by that set of corresponding threads of both screws which are at or near the upper ends of the screws at the time of entry therebetween of the product. As the corresponding sets of threads are so loaded, each product is shifted downwardly by its respective thread set, while being simultaneously urged forwardly against a stop to align the front and rear edges of the product. The initial portion of the shaft of each multi-thread screw tapers downwardly and outwardly so as to align the side edges of the products as they shift downwardly. When the stacker screws have rotated sufficiently that all of the thread sets have received a product, the thread sets terminate one-by-one in such a way as to accumulate a stack from top-to-bottom, the last thread set to terminate depositing a stack of aligned products equal in number to the number of threads per stacker screw.

When the nature and dimensions of the product demand it, more than one pair of stacker screws may be used. Under such circumstances, additional pairs will be placed in tandem with the first pair, cooperating with the first pair and operating in precisely the same manner (as will be shown hereinafter). The stacker screws can be so arranged as to deposit the stacks created thereby onto a conveyor or the like leading to further processing stations. They could, for example, deposit their stacks in packages or cartons mounted on a conveyor or the like. It is within the scope of the invention to provide a single-thread, large pitch screw in conjunction with each of the stacker screws. Each single-thread screw is located below and coaxial with its respective stacker screw, turning continuously in the same direction. The single-thread screws of a pair are mirror images of each other and are so radially aligned that corresponding parts of their threads occupy corresponding positions. If the single thread screws operate at the same rotational speed as the stacker screws, they will simply serve as additional conveying means for the stacks created by the stacker screws. When the ratio of stacker screw speed to single-thread screw speed is greater than 1:1, the single-thread screws can be used to accumulate stacks created by the stacker screws, as will be shown hereinafter.

The stop against which the forward edges of the individual products are urged for alignment can constitute a simple bar or plate appropriately positioned with respect to the stacker screws. It has been found, however, preferable and more efficient to provide a stop in the form of a flight of one or more belts moving downwardly at an appropriate speed relative to the downward motion of the products. When single-thread screws are used in conjuction with the stacker screws, two such conveyor-type stops may be employed, one for the stacker screws and one for the single-thread screws, traveling at the same or different speeds.

BRIEF DESCRIPTION OF THE DRAWINGS

FIG. 24 is a fragmentary elevational view of a stacker screw similar to that shown in FIG. 3 with wedge elements affixed at the lead ends of the threads.

FIG. 25 is a top view of the stacker screw of FIG. 24.

DETAILED DISCLOSURE OF THE INVENTION

The stacker of the present invention is intended to receive, align and stack rigid or semi-rigid (flexible) sheet or pad-like products. The term "product" as used herein and in the claims should be construed broadly enough to cover such materials including single sheets, folded sheets, single pads, or preformed stacks of sheets or pads, since the stacker is capable of accepting multiple sheet or pad input, as will be described hereinafter. For purposes of an exemplary showing and to simplify the description to follow, the invention will be described in terms of the aligning and stacking of single, unfolded sheets.

Figure 1:
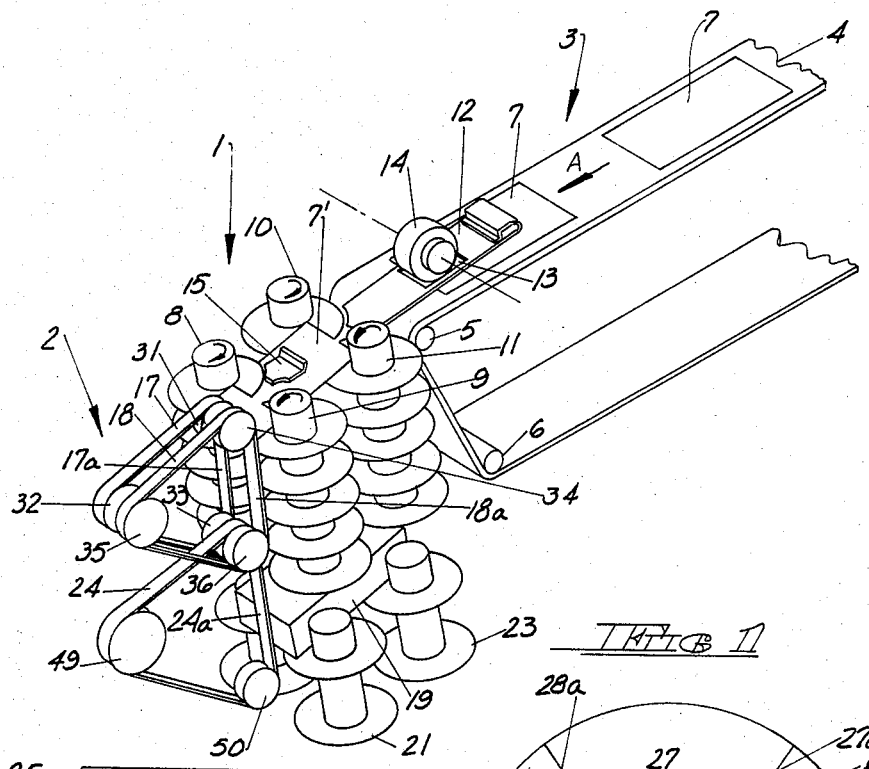
FIG. 1 is a fragmentary, semi-diagrammatic, perspective view of the stacker of the present invention and an infeed conveyor for products to be stacked.
Figure 2:
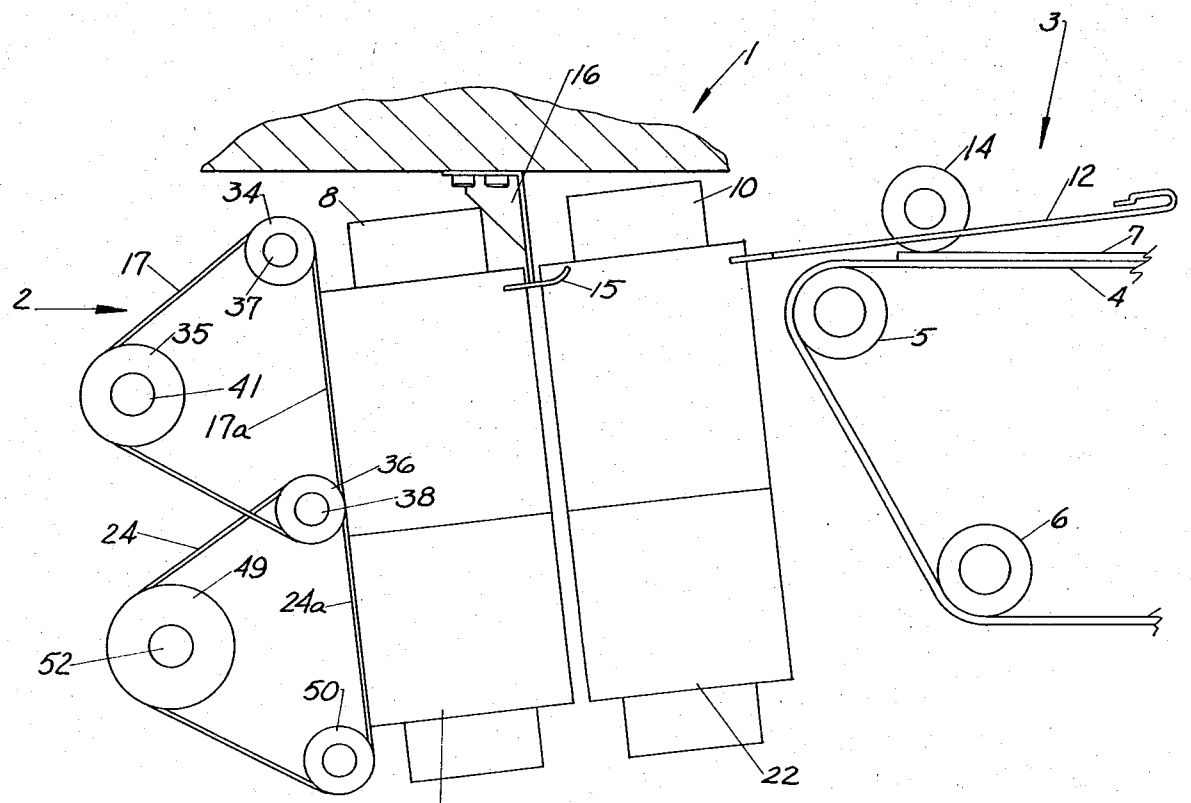
FIG. 2 is a fragmentary, semi-diagrammatic elevational view of the structure of FIG. 1, with two of the single-thread screws and two of the stacker screws removed for purposes of clarity.

Reference is first made to FIGS. 1 and 2. In these figures, the stacker is generally indicated at 1. The stacker 1 includes a front stop mechanism generally indicated at 2. The stacker is provided with products by means of an infeed conveyor, generally indicated at 3. It will be understood by one skilled in the art that infeed conveyor 3 is exemplary only, the nature of the product feeding means not constituting a limitation of the present invention.

For purposes of this description, the infeed conveyor is illustrated as comprising a conveyor belt 4 passing about rolls 5 and 6 and being driven in the direction of arrow A. The conveyor is shown as carrying single sheet products 7 evenly spaced therealong.

Assuming that the product sheets 7 are elongated as shown and comprise semi-rigid or flexible sheets, the stacker 1 is shown as having two pairs of stacker screws 8–9 and 10–11. For some types of products, only the forwardmost pair 8–9 of stacker screws would be required. On the other hand, if even more support is needed for the products, additional pairs of stacker screws could be utilized.

The stacker screws of pairs 8–9 and 10–11 are diagrammatically illustrated in FIGS. 1 and 2 (an exemplary stacker screw being shown in greater detail in FIGS. 3 through 5, to be described hereinafter). All of stacker screws 8–11 have more than one helical thread and, in fact, they all have the same number of threads. The stacker screws of a pair are mirror images of each other. Thus, stacker screw 9 is a mirror image of stacker screw 8 and stacker screw 11 is a mirror image of stacker screw 10, stacker screws 8 and 10 being identical and stacker screws 9 and 11 being identical. The stacker screws all rotate continuously at the same speed. The stacker screws of a pair rotate in opposite directions. Thus stacker screws 8 and 10 are shown rotating in a clockwise direction as viewed in the figures, while stacker screws 9 and 11 are shown rotating in a counter clockwise direction.

All of stacker screws 8 through 11 are so radially aligned that corresponding threads of these screws occupy corresponding positions. Since stacker screws 8 and 10 are in side-by-side relationship with stacker screws 9 and 11, respectively, their respective corresponding threads will occupy corresponding opposed positions between them.

When individual product sheet 7 is deposited by conveyor belt 4 onto stacker screws 8 through 11, it could land upon and be supported by those corresponding threads of screws 8 through 11 which are opposed and uppermost at the time of entry of the sheet between the stacker screws of the pairs thereof. Preferably, however, the conveyor inserts each sheet in the space or "window" between those corresponding threads of screws 8 through 11 which are opposed and uppermost at the time of entry of the sheet between the stacker screws of the pairs thereof and the corresponding threads next below the uppermost threads. Product sheet 7' is shown in this position in FIG. 1.

To assist in the proper feeding of the product sheets to the stacker screws, a plate-like top guide 12 is located above conveyor 4 and the path of travel of the product sheets. The top guide 12 has a perforation 13 therein to accommodate a nip roller 14, assisting the product sheets 7 in their entry between the stacker screw pairs. The nip roller 14 may be driven or not, as desired. To further guide the product sheets 7 and to prevent unwanted bulging thereof, a guide foot 15 is mounted between the stacker screws pairs 8–9 and 10–11, by means of a guide foot bracket 16 (see FIG. 2) and appropriately mounted on a portion of the stacker mechanism.

As is shown in FIG. 1 and more clearly in FIG. 2, the stacker 1 may be tilted slightly forwardly with respect to conveyor 3. As a result, each product sheet is afforded the maximum "window" at the time of its entrance between stacker screws 8 through 11. The amount of tilt will depend on such factors as the number of stacker screw threads, their pitch, etc.

As will be most evident from FIG. 1, the forward motion of the product sheets 7 in the direction of arrow A will be continued when the sheets enter between stacker screw pairs 8–9 and 10–11. Rotation of the stacker screws will urge the product sheets therebetween forwardly against the front stop assembly 2. Abutment of the product sheet forward edges against the front stop assembly 2 will automatically align the forward and rearward edges of the sheets. The front stop assembly could comprise one or more simple bars or plates, providing one or more stop surfaces, appropriately positioned and arranged at an angle comparable to the forward tilt angle of the stacker screws 8 through 11. It has, however, been found more efficient and desirable to provide a moving front stop assembly, moving downwardly at a speed properly matched to the downward movement of the product sheets in the stacker screws 8 through 11. To this end, a moving front stop assembly in the form of downwardly progressing flights 17*a* and 18*a* of endless belts 17 and 18 is provided. This front stop assembly will be described more fully hereinafter with respect to FIGS. 6 and 7.

As indicated above, the stacker screws 8 through 11 will both align and stack the single product sheets 7, the stacks so formed each containing a number of single sheet products equal to the number of helical threads on the individual stacker screws 8 through 11. Such a stack is shown in FIG. 1 at 19. These stacks may be deposited directly upon an appropriate output device (not shown). The output device may comprise a conveyor or the like. Indeed, the stacks may be dropped directly into packages or cartons therefore.

It is within the scope of the present invention to provide separate, single-thread screws, each located directly beneath and being coaxial with one of the stacker screws 8 through 11. FIGS. 1 and 2 illustrate pairs of single-thread screws 20–21 and 22–23. The stacks of product sheets from stacker screws 8 through 11 are deposited upon single thread screws 20 through 23. Again this is shown at 19 in FIG. 1.

It will be understood that single-thread screws 20 and 22 will be continuously driven in the same direction as stacker screws 8 and 10 while single-thread screws 21 and 23 will be continuously driven in the opposite direction, i.e. the same direction as stacker screws 9 and 11. The single threads of screws 20 through 23 will also be radially aligned such that at any given time they will occupy corresponding positions.

When single thread screws 20 through 23 are driven at the same speed as stacker screws 8 through 11 they will simply serve as additional conveying means, dropping the product stacks formed by stacker screws 8 through 11 onto an appropriate output device, one at a time. These single-thread screws 20 through 23 will always be driven at the same speed with respect to each other. Nevertheless, if they are driven at a speed less than the rotational speed of stacker screws 8 through 11, they can then be used to accumulate two or more stacks from the stacker screws prior to deposit on an appropriate output device. This will be described and illustrated hereinafter.

By virtue of the fact that single-thread screws 20 through 23 rotate in the same directions as their respective ones of stacker screws 8 through 11, the stacks 19 deposited thereon will be urged forwardly. It is therefore necessary to provide a front stop for the stack or stacks on single-thread screws 20 through 23. Such a forward stop could comprise one or more bars or plates, appropriately positioned and angled to the vertical at substantially the same angle as the single-thread screws 20 through 23. Again, however, it is desirable to provide a downwardly moving forward stop, the forward stop moving downwardly at a rate appropriately matched to the downward movement of the stacks on screws 20 through 23. To this end, a single endless driven belt 24 may be provided, the flight 24*a* of which serves as the moving forward stop. This portion of the forward stop assembly will also be described in greater detail with respect to FIGS. 6 and 7.

It will be understood by one skilled in the art that the drive means for conveyor 4, the drive means for stacker screws 8 through 11, the drive means for single-thread screws 20 through 23 and the drive means for the forward stop assembly 2, each may take any approporiate form, and these drive means do not constitute a limitation on the present invention.

Figure 3:
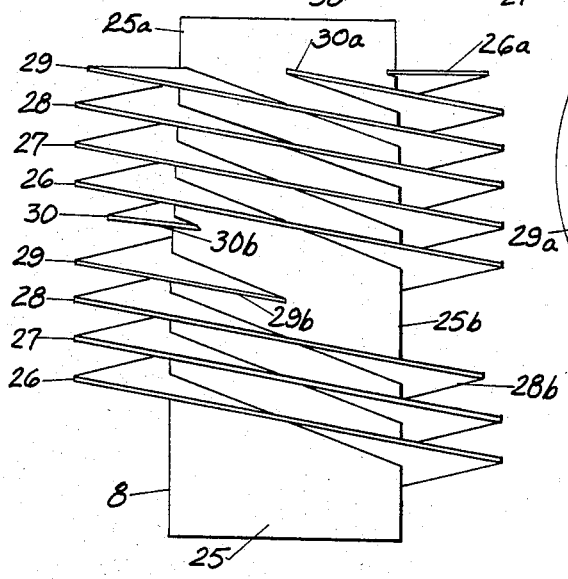
FIG. 3 is an elevational view of one of the stacker screws.
Figure 4:
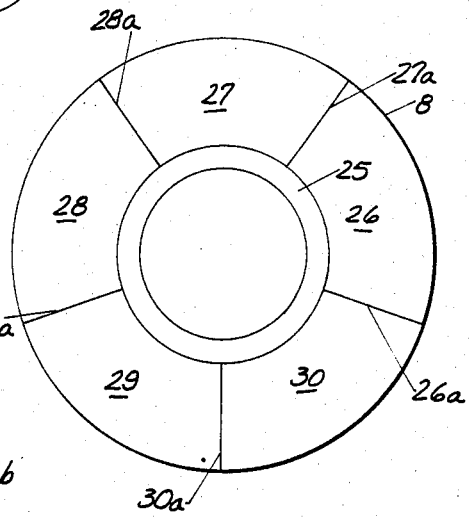
FIG. 4 is a top view of the stacker screw of FIG. 3.
Figure 5:
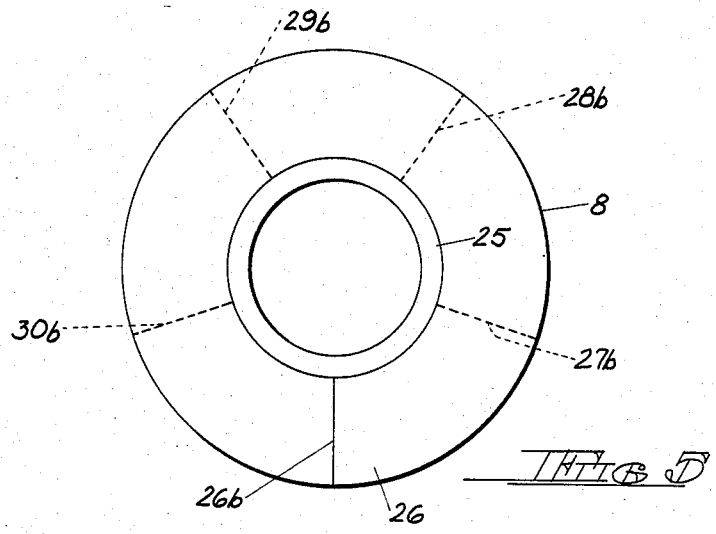
FIG. 5 is a bottom view of the stacker screw of FIG. 3.

Stacker screw 8 is illustrated in FIGS. 3 through 5. It will be understood that a description of stacker screw 8 can be considered to be a description of identical stacker screw 10. It can also be considered to be a description of stacker screws 9 and 11, differing only in that they are mirror images of stacker screw 8.

Stacker screw 8 has a central screw shaft 25 provided with helical threads. For purposes of this description, the stacker screw 8 is shown having 5 helical threads 26 through 30. As will be evident hereinafter, it could have a greater or a lesser number of threads, although it must have at least two, to fulfill its stacking purpose.

The helical threads 26 through 30 have starting edges 26*a* through 30*a* and terminating edges 26*b* through 30*b*. As will be evident from FIGS. 3 through 5 the starting edges of helical threads 26 through 30 are located at the upper end of screw shaft 25 and are substantially coplanar. The terminating edge or dropout end 26*b* of thread 26 is near the lower end of screw shaft 25. However, the terminating edges or dropout ends 27*b* through 30*b* of the remainder of the threads occur in sequence along screw shaft 25. For this reason, they are obscured by thread 26 in the bottom view of FIG. 5 and are therefore shown in broken lines. Thus, thread 30 is the first to terminate or drop out at 30*b*, followed by thread 29 at 29*b*, thread 28 at 28*b* and thread 27 at 27*b*. As will be evident hereinafter, it is this particular arrangement of threads and thread dropouts that enable stacker screws 8 through 11 to form a stack of the product sheets 7.

That portion 25*a* of screw shaft 25, located above the terminating edge or dropout end 30*b* of thread 30, is tapered in such a way as to slope downwardly and outwardly. The remainder 25*b* of screw shaft 25 is substantially cylindrical. The stacker screws of pairs 8–9 and 10–11 are spaced from each other by a distance such that the lower cylindrical portions of their respective screw shafts are separated from each other by approximately one product width. The separation of the screw shafts of the screws of a pair, near the upper ends thereof, will be greater than a product width, by virtue of the upper tapered portion of each screw shaft. As a result of this, the sides of the sheet products 7 will be appropriately aligned as the sheet products progress downwardly along the screw shafts of stacker screws 8 through 11. This action, along with the action of front stop assembly 2, will assure that the side, front and rear edges of the sheet products in a stack will all be properly aligned.

Figure 6:
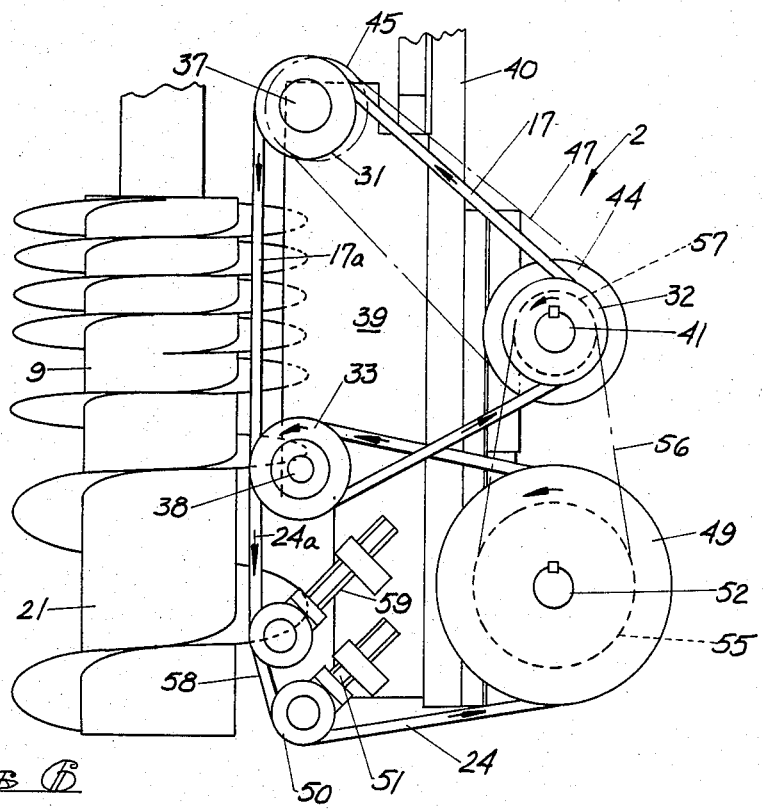
FIG. 6 is a fragmentary, somewhat simplified, side elevational view of the moving front stop of the present invention.
Figure 7:
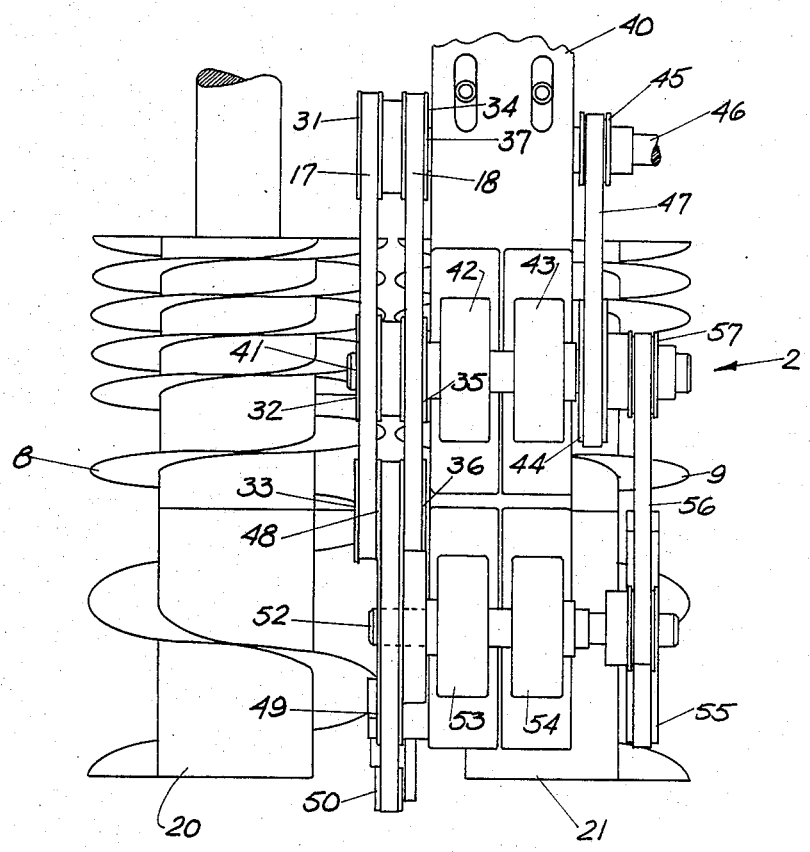
FIG. 7 is a front elevational view of the structure of FIG. 6.

Reference is now made to FIGS. 6 and 7 wherein the front stop assembly 2 is shown in greater detail. In these figures, the forward tilt of the stacking screws and the forward stop assembly has not been shown, for purposes of clarity.

Endless belt 17 is a V-belt and passes about pulleys 31, 32 and 33 (see also FIG. 1). In a similar fashion, endless V-belt 18 passes about pulleys 34, 35 and 36. Pulleys 31 and 34 are idler pulleys rotatably mounted on stationary shaft 37. Pulleys 33 and 36 are idler pulleys rotatably mounted on stationary shaft 38. The shafts 37 and 38 are, in turn, affixed to a plate 39. The plate 39, itself, is affixed to an additional plate 40. Pulleys 32 and 35 are keyed to a driven shaft 41. Shaft 41 is mounted in bearing means 42 and 43 on plate 40. A sprocket 44 is keyed to shaft 41 and is connected to a sprocket 45 on shaft 46 by a gear belt 47. The shaft 46 constitutes the main drive shaft for the front stop assembly and is operatively connected to a prime mover. By means of sprocket 45, gear belt 47 and sprocket 44, the main shaft 46 drives shaft 41 and thus V-belts 17 and 18. The forward flights 17*a* and 18*a* move continuously downwardly as is suggested in FIG. 6. By appropriately selecting sprockets 45 and 44, the speed of V-belt flights 17*a* and 18*a* can be properly matched to the speed of movement of product sheets 7 in stacker screws 8 through 11.

Endless belt 24 passes about pulleys 48, 49 and 50. Endless belt 24 is a V-belt similar to belts 17 and 18. Pulley 48 is an idler pulley rotatively mounted on stationary shaft 38. Pulley 50 is also an idler pulley, mounted by conventional adjustment means 51 to plate 39. Pulley 49 is the driving pulley, being keyed to a rotatable shaft 52 mounted in bearing means 53 and 54 on plate 40. The other end of shaft 52 carries a sprocket 55. The sprocket 55 is connected by a gear belt 56 to a sprocket 57. The sprocket 57 is, itself, keyed to rotatable shaft 41. Thus, when main drive shaft 46 drives shaft 41 through the agency of sprocket 45, gear belt 47 and sprocket 44, this will in turn cause sprocket 57 to be driven. Sprocket 57 will drive sprocket 55 by means of gear belt 56. This will result in the driving of pulley 49 mounted on the same shaft 52 as sprocket 55. In this way, V-belt 24 is so driven that its flight 24*a* will move downwardly. By appropriate selection of sprockets 57 and 55, V-belt 24 is speed-matched to the movement of the stacks of product sheets on single-thread screws 20 through 23.

All of pulleys 31 through 36 and 48 through 50 may be variable pitch pulleys (as is well known in the art), enabling fine adjustment of the speed of belt flights 17*a*, 18*a* and 24*a*. As is shown in FIG. 6, a second pulley 58 may be provided for belt flight 24. The pulley 58 is mounted by a conventional adjustment means 59 to plate 39. The pulley 58 may be used to bend the lower part of flight 24*a* away from the stacked product sheets to assure a good free drop of the stacked product sheets from stacker screws 8 through 11.

Figure 8:
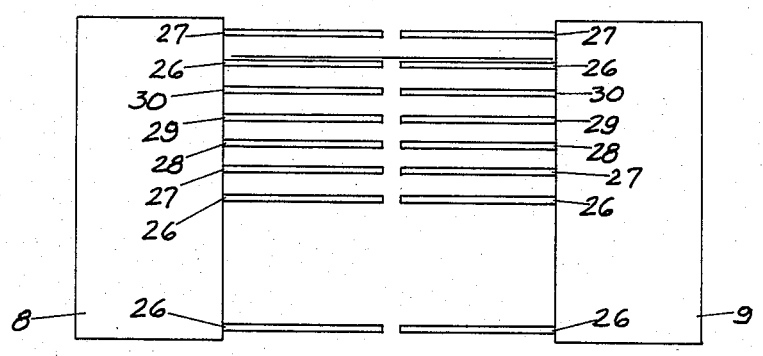
FIGS. 8 through 19 are diagrammatic representations of a pair of stacker screws, illustrating the formation and deposit of a stack of products thereby.
Figure 9:
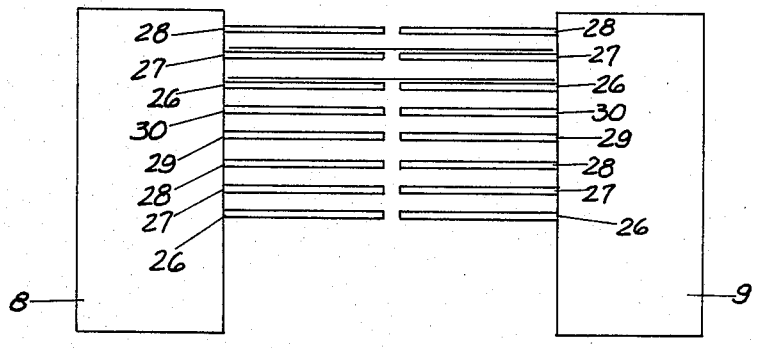
Figure 10:
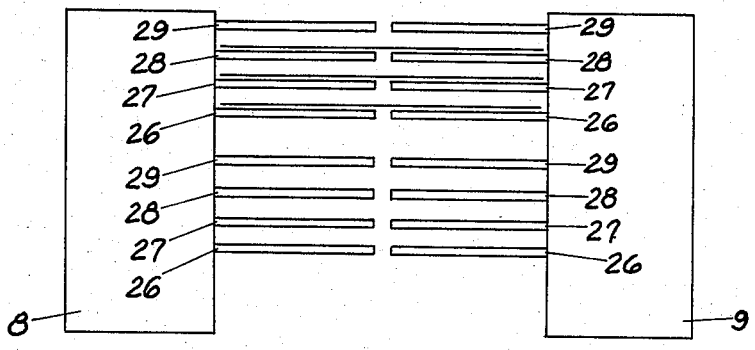
Figure 11:
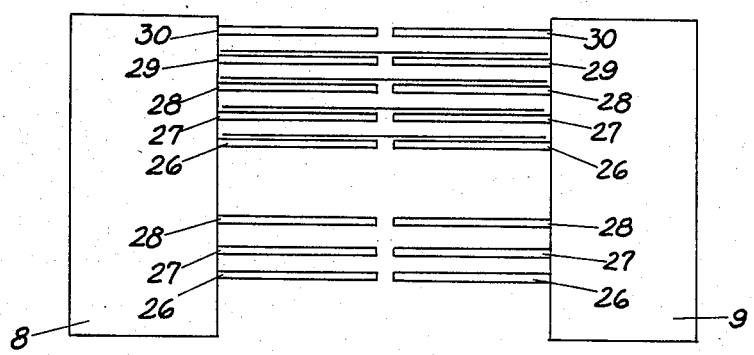
Figure 12:
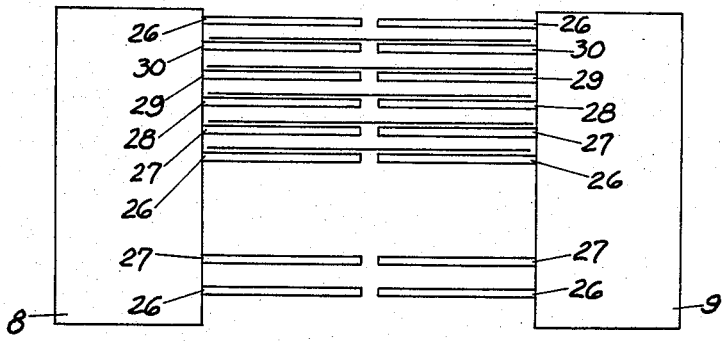

Reference is now made to FIGS. 8 through 19. These figures are diagrammatic representations of stacker screw pair 8 and 9 as viewed from the left in FIGS. 1 and 2, the forward stop assembly 2 having been eliminated. These figures show only those portions of threads 26 through 30 which are opposed between the stacker screws 8 and 9. It will be understood that stacker screw pair 10–11 will operate simultaneously in an identical manner. FIG. 8 illustrates stacker screws 8 and 9 in a position when their corresponding threads 27 are opposed and uppermost between the screws. Each of the remaining FIGS. 9 through 20 shows the relative position of the opposed corresponding screw threads after one fifth of a revolution from the preceding figure. A first product sheet is illustrated as a single full line in FIG. 8, being supported by corresponding threads 26, having entered the "window" between corresponding threads 26 and 27. One fifth revolution later, as shown in FIG. 9, corresponding threads 26 and their product sheet have moved downwardly. Corresponding threads 28 are now uppermost and corresponding threads 27 receive a product sheet. This procedure is repeated through FIG. 12. In FIG. 12 all of corresponding threads 26 through 30 support a product sheet. The five product sheets shown as single lines in FIG. 12 will ultimately make up into a first stack. FIG. 12 represents four fifths of a revolution of stacker screws 8 and 9.

Figure 13:
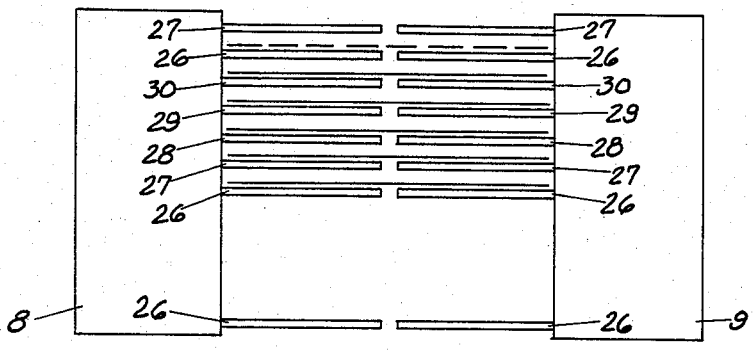
Figure 14:
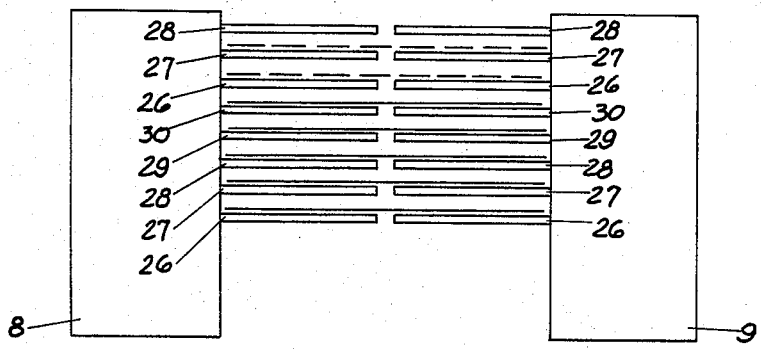

At one full revolution, as represented by FIG. 13, the original five product sheets continue to move downwardly. Corresponding threads 27 are again uppermost between stacker screws 8 and 9 and thus corresponding threads 26 again receive another sheet indicated in broken lines. This product sheet, indicated by broken lines, will be the first or lowermost in a second stack of sheets. In FIG. 14, illustrating one and one fifth revolutions, an additional broken line sheet of the second stack is added and the original five sheets making up the first stack have moved further down the stacking screws. During the time represented by FIGS. 8 through 14, all of the first five sheets which will ultimately make up the first stack have passed through the tapered portions of the screw shafts of stacker screws 8 and 9 so that they are properly aligned side-to-side.

Figure 15:
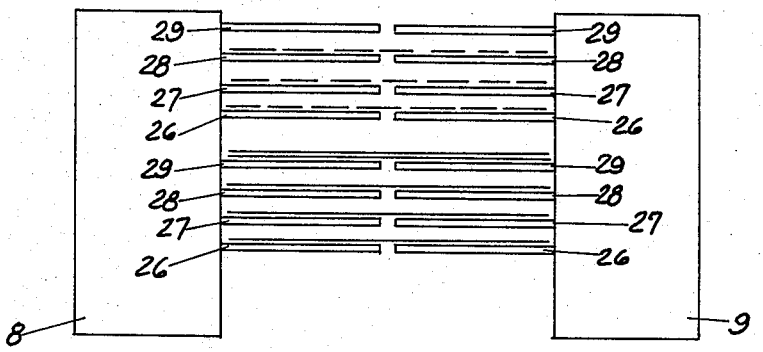

FIG. 15 represents one and two fifths revolutions of stacker screws 8 and 9. A third product sheet has been added which will make up a part of the second stack. It will be noted, however, that corresponding threads 30 have terminated or dropped out causing the upper two of the first five sheets to stack on corresponding threads 29.

Figure 16:
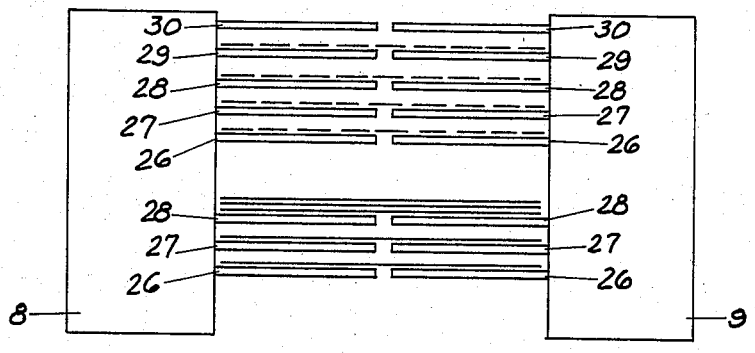

At one and three fifths revolutions, represented by FIG. 16, corresponding threads 29 have dropped out from the two uppermost stacked product sheets of the first group of five, causing them to stack with the third sheet of the first group of five on corresponding threads 28. At the same time, a fourth one of the sheets which will make up the second stack has been loaded onto stacking screws 8 and 9.

Figure 17:
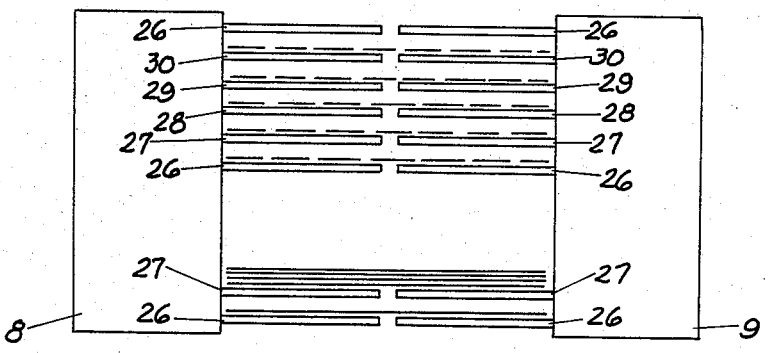
Figure 18:
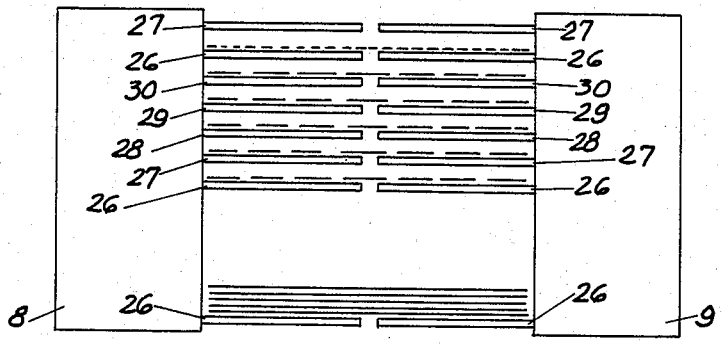

FIG. 17 represents one and four fifths revolutions of stacking screws 8 and 9. At this point, corresponding threads 30 receive the last of the series of sheets which will make up the second stack of sheets. Furthermore, at this point, the corresponding threads 28 of FIG. 16, which supported the upper three sheets of those which will form the first stack, have dropped out with the result that corresponding threads 27 now support the upper four sheets of what will ultimately be the first stack.

At two complete revolutions, (FIG. 18) corresponding threads 27 drop out and corresponding threads 26 now hold the first completed stack of product sheets. The sheets which will make up the second stack have progressed further downwardly, and the first sheet (shown in dotted lines) of what will ultimately be the third stack has been added to stacking screws 8 and 9.

Figure 19:
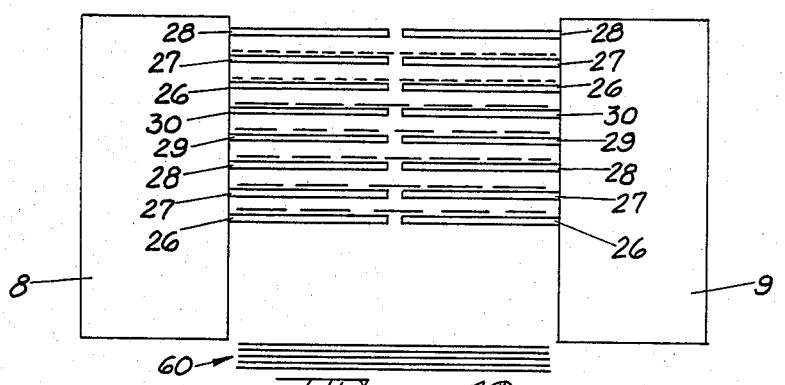
Figure 20:
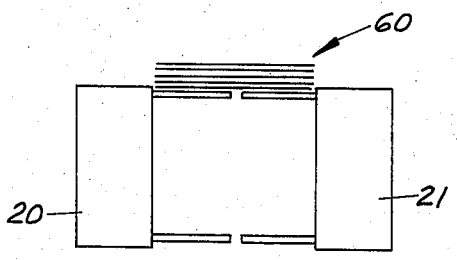
FIGS. 20 through 23 are diagrammatic representations of a pair of single-thread screws, illustrating the accumulation and deposit of three stacks thereby.
Figure 21:
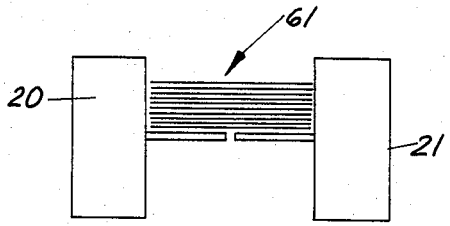

In FIG. 19 (two and one fifth revolutions), corresponding threads 26 have dropped out and the first stack of product sheets has been discharged from stacker screws 8 and 9. Those sheets which will ultimately make up the second stack are one fifth of a revolution away from beginning the stacking procedure. The second product sheet of what will ultimately be the third stack has been added to stacker screws 8 and 9.

The first stack, generally indicated at 60, can be received on an appropriate output device (as described above) or can be received on the threads of the single-thread screws 20 through 23.

FIGS. 20 through 23 are diagrammatic representations, similar to those of FIGS. 8 through 19, but illustrating the single-thread screw pair 20–21. It will be understood that the single-thread screw pair 22–23 will operate simultaneously in an identical manner.

Figure 22:
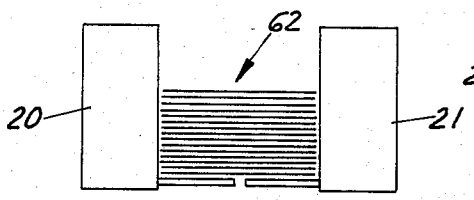
Figure 23:
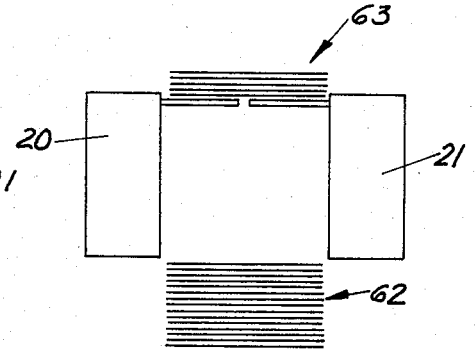
Figure 5:
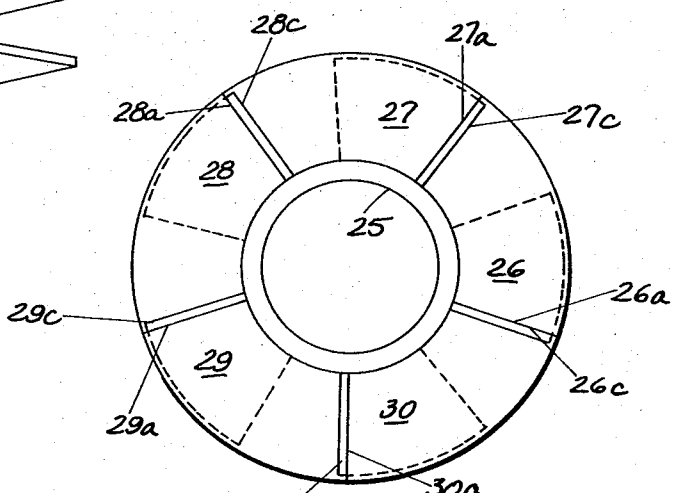
Figure 4:
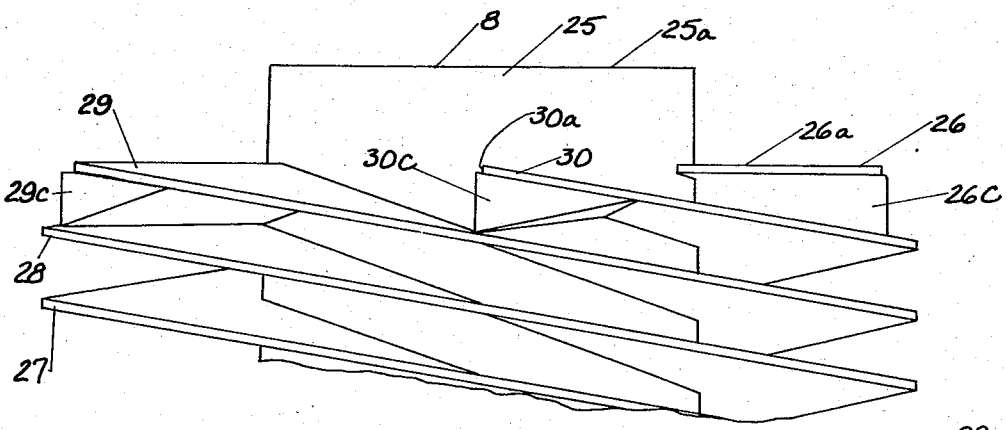

In the sequence illustrated in FIGS. 20 through 23 the single-thread screws 20 and 21 are, for purposes of an exemplary showing, to be considered as rotating at such a speed that the ratio of the speed of rotation of stacker screws 8 and 9 to the speed of rotation of single-thread screws 20 and 21 is 3:1. The single-thread screws 20 and 21 will receive the first stack of five products, generally indicated at 60 in FIG. 20, from stacker screws 8 and 9. Thereafter, the second stack of five products will be received from stacker screws 8 and 9, making a total stack of 10 products, generally indicated at 61 in FIG. 21. Thereafter, a third stack of five products will be received from stacker screws 8 and 9, producing a total stack of 15 products, generally indicated at 62 in FIG. 22. FIG. 22 represents the single-thread screws 20 and 21 just before they have completed one full revolution. FIG. 23 illustrates single-thread screws 20 and 21 just after having completed one full revolution. At this point, the bottom ends of the threads drop out, dropping the stack 62 of 15 product sheets upon an appropriate output means (not shown). In the meantime, the upper ends of the threads of the single-thread screws 20 and 21 have already received another stack of five products generally indicated at 63, from stacker screws 8 and 9 and has begun to repeat the process of accummulating three stacks from the stacker screws.

It will be apparent that if the ratio of the rotational speed of stacker screws 8 and 9 and the rotational speed of single-thread screws 20 and 21 was 1:1, then the single-thread screws 20 and 21 would deliver to the output device individual stacks of five products from the stacker screws 8 and 9, serving simply as an additional conveyor means. If the rotational speed ratio were 2:1, then the single-thread screws 20 and 21 would deposit on the output device accummulated stacks of 10 product sheets each.

The example set forth above and illustrated in FIGS. 8 through 19 is ideal in that the first set of corresponding threads to receive a product sheet was made up of threads 26, those threads which are last to terminate or fall out. At start-up time, any corresponding set of threads could be uppermost so as to receive the first product sheet. When any set of threads, other than that made up of threads 26, are the first to receive a product sheet at start-up, the first stack created by the stacker threads will not contain a full count. Thus, at start-up, it is advisable to remove the first stack produced by the stacker screws or the first stack produced by the single-thread screws, if used, and either dispose of or recycle these sheets, depending upon the nature of the product. Alternatively, the device at start-up could always be so pre-aligned that corresponding threads 26 always are the first to receive a product sheet. This would preclude any problem of disposal or recycling.

The stacker of the present invention can have numerous variations, tailoring it to the nature of the product being handled and to the desired output, including stack count. As indicated above, at least one pair of stacker screws are required. When the product is of sufficient length and such nature as to require it, more than one pair of stacker screws can be used, as is clearly shown in FIG. 1. In order to perform their stacking function, the stacker screws must have at least two threads. The number of threads can be increased without limit, other than a practical one. The stacker screws will always produce a stack having a stack count equal to the number of threads per stacker screw. Thus, when dealing with products in the form of single sheets (or pads), two-threaded stacker screws will produce stacks of two sheets, three-threaded stacker screws will produce stacks of three sheets, four-threaded stacker screws will produce stacks of four sheets, five-threaded stacker screws will produce stacks of five sheets, and so on.

As indicated above, the stacker of the present invention is capable of accepting a multiple sheet input. As as example of how this might come about, consider a line handling a roll of product material having a width equal to twice the width of the ultimate product. The material from the roll could be sheared into two strips of product width. These strips, in turn, could be placed one upon the other and sheared into product lengths. Under these circumstances, the conveyor belt 4 (see FIGS. 1 and 2) could feed pre-made stacks of two sheets to the stacker screws 8 through 11. These pre-made stacks are hereinafter and in the claims referred to as "clips". When such clips are fed to stacker screws 8 to 11, the stacker screws will produce stacks containing a number of sheets equal to the number of threads per stacker screw times the number of sheets per clip. Thus, in an instance where the stacker screws have two threads and are fed clips of two sheets, stacks of four sheets will be produced by the stacker threads. Clips of two sheets, when fed to stacker screws having five threads each, will be formed into stacks of ten sheets thereby. On the other hand, if the initial roll of product material is five product widths wide, sheared into five single product width strips which are then placed one above the other and cut to product length, each clip will contain five sheets. Such clips, when fed to stacker screws having two threads, will be formed into stacks of ten. Such clips, when fed to stacker screws of five threads each, will be formed into stacks of twenty five sheets.

When single-thread screws are used in conjunction with the stacker screws, they will be used in pairs equal in number to the pairs of stacker screws used. When the rotational speed of the stacker screws and the rotational speed of the single-threaded screws are in the ratio of 1:1, the single-thread screws are simply acting as conveyors and will deposit, one-by-one, the stacks produced by the stacker screws, without accummulation thereof. If the ratio of the rotational speed of the stacker screws to the single-thread screws is 2:1, then the single-thread screws will deposit stacks made up of two stacks from the stacker screws. Thus, if the stacker screws produce stacks of ten sheets, the single-thread screws will produce stacks of 20 sheets, and so on. If the rotational speed of the stacker screws to the single-thread screws is 3:1, the single-thread screws will accummulate three stacks produced by the stacker screws and deposit them as a single stack on the output device. Thus, if the stacker screws produce stacks of five sheets, the single-threaded screws will produce stacks of fifteen sheets. Similarly, if the stacker screws produce stacks of ten sheets, the single-thread screws will produce stacks of 30 sheets.

From the above, it will be evident that stacks of a specific count can be achieved by means of the proper selection of the stacker screws, the number of sheets fed to the stacker screws at a given time, and through the use of single-thread screws, if needed.

It has been found that, when dealing with soft and flexible product sheets and clips thereof, some crushing of the forward edges of the product sheets or clips can occur when they make initial contact with the moving stop flights 17*a* and 18*a*. The speed of these sheets or clips at insertion is generally greater than the rotational speed of stacking screws 8 through 11. This crushing of the leading edges of the sheets can result in distortion of the ultimate sheet stacks, the leading edges of the stacks tending to be thicker than the trailing edges.

It has been determined that this crushing phenomenon can be minimized or eliminated through the provision of a wedge element at or near the starting edges of the corresponding threads of the forward pair (8 and 9) of the stacker screws. FIG. 24 is a fragmentary elevational view of stacker screw 8, similar to FIG. 3, and like parts have been given like index numerals. FIG. 25 is a top view of stacker screw 8, similar to FIG. 4, and again like parts have been given like index numerals. As is most clearly shown in FIG. 24, a wedge element 30*c* is affixed to thread 30 at its starting edge 30*a*. While it is so illustrated, the wedge element 30*c* need not be located directly at starting edge 30*a*. The wedge 30*c* may be affixed to the underside of thread 30, or to the screw shaft 25, or both, by any appropriate means, such as fastening means, adhesive means or the like (not shown). On the other hand, the wedge element 30*c* could be a molded, integral, one-piece part of thread 30.

As is shown in FIG. 24, thread 26 is similarly provided with a wedge element 26*c* and thread 29 is provided with a similar wedge element 29*c*. Wedge elements 27*c* and 28*c* are provided for threads 27 and 28, as is shown in FIG. 25.

As is evident from FIG. 24, the wedge 30*c* closes the window between threads 30 and 29. The wedge 29*c* closes the window between threads 29 and 28. Similarly, the wedge 26*c* will close the window between threads 30 and 26, while the wedge 27*c* will close the window between threads 26 and 27, and the wedge 28*c* will close the window between threads 27 and 28.

Returning again to FIG. 24, it will be evident to one skilled in the art that when a product sheet or clip (not shown) is inserted in the window between threads 30 and 29 and the corresponding threads on stacker screw 9, the forward edge of the sheet or clip will contact wedge 30*c* and the corresponding wedge on stacker screw 9. These wedges will accomplish two functions. First of all, they will direct the sheet or clip downwardly against the upper surface of thread 29 and the corresponding thread on stacker screw 9. Secondly, it will slow the incoming sheet or clip down to the rotational speed of stacker screws 8 and 9. Thus, the wedges will decelerate the incoming sheet or clip to the speed of stacker screws 8 and 9 (and the other stacker screws 10 and 11 rotating at the same speed). The forward motion of the sheet or clip will be completely terminated when it contacts stop flights 17*a* and 18*a*. As a result, the reduction in momentum of the incoming sheet or clip occurs in two steps and the wedges will also contain the reaction of the sheet or clip at high speeds. The remaining wedges 26*c* through 29*c* (and their counterparts on stacker screw 9) will function in the same manner. It will be understood that stacker screws 10 and 11 will not be provided with wedges. Wedges of the type just described can be applied to stacker screws having any appropriate number of threads.

Modifications may be made in the invention without departing from the spirit of it.

What is claimed is:

1. A stacker for rigid and flexible sheet and pad-like products forming individual stacks thereof of specific count, said stacker comprising at least one pair of stacker screws, each stacker screw having at least two helical threads, each thread having a starting edge and a terminating edge, all of said terminating edges of said screw being below all of said starting edges, said stacker screws of said at least one pair having the same number of threads and being mirror images of each other, said stacker screws rotating at the same speed and in opposite directions, said stacker screws being so radially aligned that corresponding threads thereof occupy corresponding positions, said stacker screws of said at least one pair being arranged in side-by-side relationship with their corresponding threads opposed, means to continuously feed products between said screws onto said starting edges of said helical threads of said at least one pair such that each product is supported by corresponding threads of said screws, said corresponding threads being so configured that each of said products is shifted downwardly thereby, said corresponding threads of said screws of said at least one pair terminate one-by-one such that a stack of said products is accumulated from top-to-bottom, the last of said corresponding threads to terminate depositing said product stack.

2. The stacker claimed in claim 1 including at least two pairs of said stacker screws positioned one behind the other, said second pair being identical to the first pair in structure, direction of rotation, rotational speed, and thread alignment, said products being supported by corresponding threads of both pairs of said stacker screws.

3. The stacker claimed in claim 1 wherein the number of products per stack is equal to the number of threads per stacker screw.

4. The stacker claimed in claim 1 wherein said means to continuously feed products between said stacker screws feed clips products, each clip containing more than one product, each stack of products containing a number of products equal to the number of threads per stacker screw times the number of products per clip.

5. The stacker claimed in claim 1 wherein the axes of said stacker screws are equally tilted with respect to the vertical and away from said product feeding means to facilitate feeding of said products between said stacker screws.

6. The stacker claimed in claim 1 including a stop located adjacent said pair of stacker screws, said stop having at least one planar surface parallel to the axes of said stacker screws and against which said products are constantly urged by said rotation of said stacker screw threads whereby to align the front and rear edges of said products during stacking thereof.

7. The stacker claimed in claim 1 wherein each of said stacker screws has a shank from which said threads extend, the upper portion of said shank above the first thread termination tapering downwardly and outwardly, the remainder of said shank being cylindrical, the cylindrical portions of the shanks of a stacker screw pair being spaced from each other by a distance substantially equal to the product width whereby the sides of said products are aligned.

8. The stacker claimed in claim 1 including at least one pair of single-thread large pitch screws, each located beneath and being coaxial with one of said stacker screws of said at least one pair thereof, said single-thread screws of said pair being mirror images of each other, rotating at the same speed, rotating in the same direction as their respective stacker screws and being so radially aligned that their single threads occupy corresponding positions.

9. The stacker claimed in claim 2 wherein the number of products per stack is equal to the number of threads per stacker screw.

10. The stacker claimed in claim 2 wherein said means to continuously feed products between said stacker screws feeds clips of products, each clip containing more than one product, each stack of products containing a number of products equal to the number of threads per stacker screw times the number of products per clip.

11. The stacker claimed in claim 2 wherein the axes of said stacker screws are equally tilted with respect to the vertical and away from said product feeding means to facilitate feeding of said products between said stacker screws.

12. The stacker claimed in claim 2 including a stop located adjacent the forwardmost of said pairs of stacker screws, said stop having at least one planar surface parallel to the axes of said forwardmost pair of stacker screws and against which said products are constantly urged by said rotation of said stacker screw threads whereby to align the front and rear edges of said products during stacking thereof.

13. The stacker claimed in claim 2 wherein each of said stacker screws has a shank from which said threads extend, the upper portion of said shank above the first thread termination tapering downwardly and outwardly, the remainder of said shank being cylindrical, the cylindrical portions of the shanks of a stacker screw pair being spaced from each other by a distance substantially equal to the product width whereby the sides of said products are aligned.

14. The stacker claimed in claim 2 including at least two pairs of single-thread large pitch screws, each located beneath and being coaxial with one of said stacker screws of said at least two pairs thereof, said single-thread screws of each of said pairs thereof being mirror images of each other and rotating in the same direction as their respective stacker screws, all of said single-thread screws rotating at the same speed and being so radially aligned that their single threads occupy corresponding positions.

15. The stacker claimed in claim 6 including a wedge-shaped element in association with each thread of each of said stacker screws of said pair, the wedge-shaped elements of said corresponding threads of said stacker screws being mirror images of each other, occupying corresponding positions and having downwardly and forwardly sloping surfaces so configured as to be contacted by said front edges of said products fed to said corresponding threads to urge each product downwardly against its respective supporting corresponding threads and to slow each product to the rotational speed of its corresponding supporting threads prior to contact with said stop.

16. The stacker claimed in claim 6 wherein said stop comprises at least one endless belt, said planar surface comprising the exterior surface of one flight of said at least one endless belt, means to drive said belt such that said flight moves downwardly at a speed matched to the downward movement of said products.

17. The stacker claimed in claim 8 wherein said single-thread screws comprise conveying screws rotating at the same speed as said stacker screws.

18. The stacker claimed in claim 8 wherein said single-thread screws comprise stack accumulating screws rotating at a speed slower than that of said stacker screws.

19. The stacker claimed in claim 8 including a stop located adjacent said pair of single-thread screws, said stop having at least one planar surface parallel to the axes of said single-thread screws and against which said product stacks are constantly urged by said rotation of said single-thread screw threads whereby to maintain front and rear alignment of said products in said stacks.

20. The stacker claimed in claim 12 including a wedge-shaped element in association with each thread of each of said stacker screws of said forwardmost pair, the wedge-shaped elements of said corresponding threads of said forwardmost pair of stacker screws being mirror images of each other, occupying corresponding positions and having downwardly and forwardly sloping surfaces so configured as to be contacted by said front edges of said products fed to said corresponding threads to urge each product downwardly against its respective supporting corresponding threads and to slow each product to the rotational speed of its corresponding supporting threads prior to contact with said stop.

21. The stacker claimed in claim 12 wherein said stop comprises at least one endless belt, said planar surface comprising the exterior surface of one flight of said at least one endless belt, means to drive said belt such that said flight moves downwardly at a speed matched to the downward movement of said products.

22. The stacker claimed in claim 14 wherein said single-thread screws comprise conveying screws rotating at the same speed as said stacker screws.

23. The stacker claimed in claim 14 wherein said single-thread screws comprise stack accumulating screws rotating at a speed slower than that of said stacker screws.

24. The stacker claimed in claim 14 including a stop located adjacent the forwardmost pair of said single-thread screws, said stop having at least one planar surface parallel to the axes of said single-thread screws and against which said product stacks are constantly urged by said rotation of said single-thread screws whereby to maintain front and rear alignment of said products in said stacks.

25. The stacker claimed in claim 19 wherein said stop comprises at least one endless belt, said planar surface comprising the exterior surface of one flight of said at least one endless belt, means to drive said belt such that said flight moves downwardly at a speed matched to the downward movement of said products.

26. The stacker claimed in claim 24 wherein said stop comprises at least one endless belt, said planar surface comprising the exterior surface of one flight of said at least one endless belt, means to drive said belt such that said flight moves downwardly at a speed matched to the downward movement of said products.

* * * * *

UNITED STATES PATENT AND TRADEMARK OFFICE

CERTIFICATE OF CORRECTION

PATENT NO. : 4,547,114

DATED : October 15, 1985

INVENTOR(S) : Howard N. Watrous, Walter Cash, Jr. and Weldon R. Dixon

It is certified that error appears in the above-identified patent and that said Letters Patent is hereby corrected as shown below:

Column 2, line 59, after "the like." start a new paragraph.

Column 6, line 20, "approporiate" should read -- appropriate --.

Column 10, line 24, delete "as", second occurrence.

Column 12, line 51, Claim 4, "feed" should read -- feeds --.

Column 12, line 51, Claim 4, after "clips" insert -- of --.

Signed and Sealed this

*Eighteenth* Day of *February 1986*

[SEAL]

*Attest:*

DONALD J. QUIGG

*Attesting Officer* *Commissioner of Patents and Trademarks*